US009593557B2

(12) United States Patent
Kim

(10) Patent No.: US 9,593,557 B2
(45) Date of Patent: Mar. 14, 2017

(54) SYSTEM AND METHOD FOR AUTONOMOUS DOWNHOLE POWER GENERATION

(71) Applicant: Namhyo Kim, Houston, TX (US)

(72) Inventor: Namhyo Kim, Houston, TX (US)

(73) Assignee: CHEVRON U.S.A. INC, San Ramon, CA (US)

( * ) Notice: Subject to any disclaimer, the term of this patent is extended or adjusted under 35 U.S.C. 154(b) by 215 days.

(21) Appl. No.: 14/496,682

(22) Filed: Sep. 25, 2014

(65) Prior Publication Data

US 2016/0090820 A1 Mar. 31, 2016

(51) Int. Cl.
*E21B 41/00* (2006.01)

(52) U.S. Cl.
CPC ..... *E21B 41/0085* (2013.01)

(58) Field of Classification Search
CPC ..... E21B 41/0085
See application file for complete search history.

(56) References Cited

U.S. PATENT DOCUMENTS 4,491,738 A * 1/1985 Kamp ..... E21B 41/0085 175/40
5,839,508 A 11/1998 Tubel et al.
6,279,651 B1 * 8/2001 Schwendemann .. E21B 41/0035 166/54.1
8,680,704 B1 * 3/2014 Rooney ..... F03B 13/02 290/54
2003/0178205 A1 * 9/2003 Henderson ..... E21B 23/04 166/387
2008/0047753 A1 * 2/2008 Hall ..... E21B 41/0085 175/57
2012/0091732 A1 * 4/2012 Fallet ..... E21B 41/0085 290/40 R
2016/0090819 A1 * 3/2016 Kim ..... E21B 41/0085 166/244.1
2016/0090820 A1 * 3/2016 Kim ..... E21B 41/0085 166/244.1
2016/0090821 A1 * 3/2016 Kim ..... E21B 41/0085 166/53
2016/0126865 A1 * 5/2016 Kim ..... H02N 2/185 310/339
2016/0126866 A1 * 5/2016 Kim ..... H02N 2/185 310/339

(Continued)

*Primary Examiner* — Kenneth L Thompson
*Assistant Examiner* — Steven MacDonald
(74) *Attorney, Agent, or Firm* — King & Spalding LLP

(57) ABSTRACT

An autonomous downhole power generation system includes a power generation device configured to be disposed in an annular space around a portion of a production tubing, wherein the power generation device is switchable between a power generation mode and a bypass mode. The system further includes a power storage device electrically coupled to the power generation device and configured to store power generated by the power generation device. The system also includes a control processor communicatively coupled to the power storage device and the power generation device, wherein the control processor receives a measure of power stored in the power storage device and switches the power generation device between the power generation mode and the bypass mode based on the measure of power or an preprogrammed operational protocol.

9 Claims, 4 Drawing Sheets

(56) References Cited

U.S. PATENT DOCUMENTS

2016/0126867 A1* 5/2016 Kim ..... H02N 2/185
310/339
2016/0164437 A1* 6/2016 Kim ..... H02N 2/185
310/339

* cited by examiner

SYSTEM AND METHOD FOR AUTONOMOUS DOWNHOLE POWER GENERATION

RELATED APPLICATIONS

The present application is related to U.S. patent application Ser. No. 14/496,673, titled "Downhole Power Generation System And Method," and filed concurrently herewith; and U.S. patent application Ser. No. 14/496,688, titled "Downhole Power Generation System with Alternate Flow Paths," and filed concurrently herewith.

TECHNICAL FIELD

The present application relates to downhole power generation. Specifically, the present application relates to an autonomous downhole power generation system with extended life.

BACKGROUND

In certain downhole operations, power is needed to run various components of a downhole assembly. For example, power is needed to drive actuators for valves and other components, and to power various sensors and communication devices. In many cases, power is generated downhole via a downhole power generation device that is coupled to the downhole assembly. Some of the devices may be designed to use mechanical power from the fluid flow to generate electric power downhole such as the mechanisms using flow induced vibration, turbomachinery, and the like. However, when such power generation mechanism is designed to run continuously, it must endure a large amount of stress and wear. This leads to a short operating device life. This is a problem because maintenance of such devices is extremely difficult and often impossible, and the expected life of such devices is much shorter than the life of the well. Additionally, such power generation devices typically generate more power than is needed to carry out the functions of the downhole assembly. Thus, the stress and wear seen by the power generation mechanism in generating the excess power does not translate into increased utility.

SUMMARY

In general, in one aspect, the disclosure relates to an autonomous downhole power generation system. The system includes a power generation device configured to be disposed in an annular space around a portion of a production tubing, wherein the power generation device is switchable between a power generation mode and a bypass mode. The system further includes a power storage device electrically coupled to the power generation device and configured to store power generated by the power generation device. The system also includes a control processor communicatively coupled to the power storage device and the power generation device, wherein the control processor receives a measure of power stored in the power storage device and switches the power generation device between the power generation mode and the bypass mode based on the measure of stored electric power in the storage device.

In another aspect, the disclosure can generally relate to an autonomous downhole power generation system. The system includes a power generation device configured to be disposed in an annular space around a portion of a production tubing, wherein the power generation device is switchable between a power generation mode and a bypass mode. The system also includes a power storage device electrically coupled to the power generation device and configured to store power generated by the power generation device. The system further includes a control processor communicatively coupled to the power generation device, wherein the control processor switches the power generation device between the power generation mode and the bypass mode based on a preprogrammed operational protocol.

In another aspect, the disclosure can generally relate to a method of generating power in a downhole environment. The method includes detecting, by a control processor, a measured power level of a power storage device or an operational condition. The method also includes determining, by the control processor, that the measured power level of the power storage device is below a first threshold level or that the operational condition matches one of a plurality of predefined activation conditions. The method further includes switching, by the control processor, a power generation device from a bypass mode to a power generation mode, wherein the power generation device generates power via a power generation mechanism when in the power generation mode, and bypasses the power generation mechanism in the bypass mode.

These and other aspects, objects, features, and embodiments will be apparent from the following description and the appended claims.

BRIEF DESCRIPTION OF THE DRAWINGS

The drawings illustrate only example embodiments of the present disclosure, and are therefore not to be considered limiting of its scope, as the disclosures herein may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements. In one or more embodiments, one or more of the features shown in each of the figures may be omitted, added, repeated, and/or substituted. Accordingly, embodiments of the present disclosure should not be limited to the specific arrangements of components shown in these figures.

DETAILED DESCRIPTION OF EXAMPLE EMBODIMENTS

Figure 1:
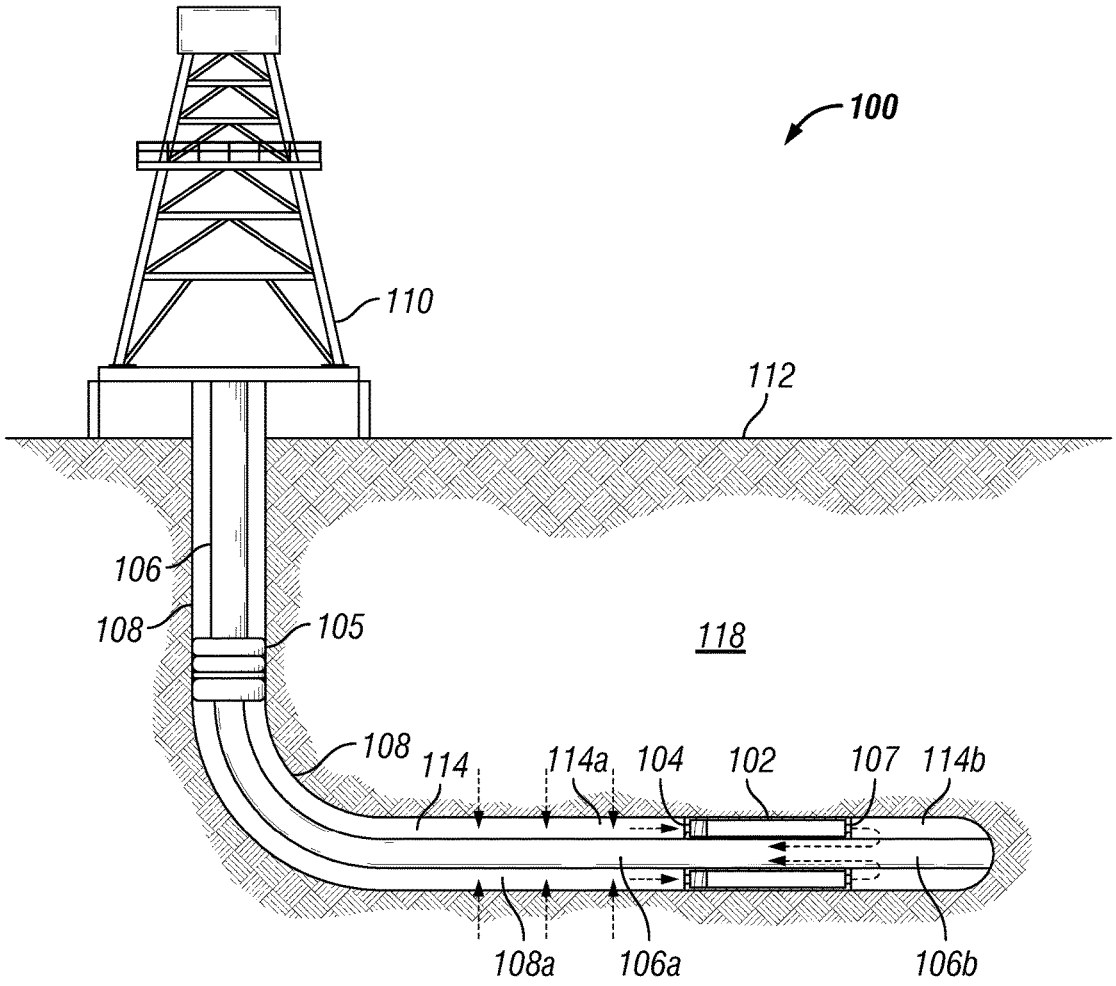
FIG. 1 illustrates a schematic diagram of a well site in which an autonomous downhole power generation system has been deployed, in accordance with example embodiments of the present disclosure.

Example embodiments directed to an autonomous downhole power generation system will now be described in detail with reference to the accompanying figures. Like, but not necessarily the same or identical, elements in the various figures are denoted by like reference numerals for consistency. In the following detailed description of the example embodiments, numerous specific details are set forth in order to provide a more thorough understanding of the disclosure herein. However, it will be apparent to one of ordinary skill in the art that the example embodiments disclosed herein may be practiced without these specific details. In other instances, well-known features have not been described in detail to avoid unnecessarily complicating the description. The example embodiments illustrated herein include certain components that may be replaced by alternate or equivalent components in other example embodiments as will be apparent to one of ordinary skill in the art.

Referring now to the drawings, FIG. 1 illustrates a schematic diagram of a well site 100 in which an autonomous downhole power generation system 102 has been deployed, in accordance with example embodiments of the present disclosure. In certain example embodiments, and as illustrated, the autonomous downhole power generation system 102 (hereinafter "power generation system") is deployed in a wellbore 108. The wellbore 108 is formed in a subterranean formation 118 and coupled to a rig 110 on a surface 112 of the formation 118. The formation 118 can include one or more of a number of formation types, including but not limited to shale, limestone, sandstone, clay, sand, and salt. The surface 112 may be ground level for an on-shore application or the sea floor for an off-shore application. In certain embodiments, a subterranean formation 118 can also include one or more reservoirs in which one or more resources (e.g., oil, gas, water, steam) are located. In certain example embodiments, the wellbore 108 is cased with cement or other casing material, which is perforated to allow fluids to flow from the formation 118 into the wellbore 108. In certain example embodiments, the well 108 is a multi-zone well. A production tubing 106 is disposed downhole within the wellbore 108. Fluids are recovered and brought to the rig 110 through the production tubing. In certain example embodiments, a production packer 105 is coupled to the production tubing 106.

Figure 2:
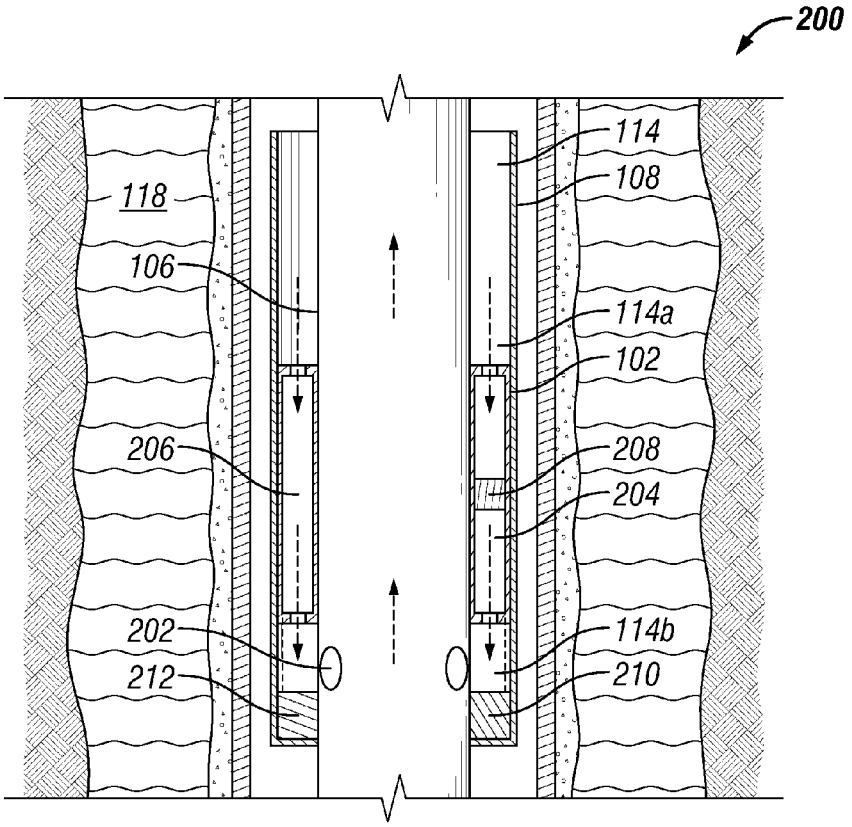
FIG. 2 illustrates a cross-sectional diagram of the power generation system disposed around the production tubing, in accordance with example embodiments of the present disclosure.

In certain example embodiments, the power generation system 102 is disposed in an annular space 114 around a portion of the production tubing 106. The annular space 114 is the space between the production tubing 106 and the wellbore 108. FIG. 2 illustrates a cross-sectional diagram 200 of the power generation system 102 disposed around the production tubing 106, in accordance with example embodiments of the present disclosure. Referring to FIGS. 1 and 2, in certain example embodiments, the power generation system 102 is sealed between the production tubing 106 and the wellbore 108 such that fluid traveling from a first portion of the annular space 114*a* to a second portion 114*b* of the annular space is forced to travel through the power generation system 102, in which the first portion of the annular space 114*a* is adjacent a first end 104 of the power generation system 102 and the second portion of the annular space 114*b* is adjacent a second end 107 of the power generation system 102. In certain example embodiments, a portion of the wellbore 108 adjacent the first portion of the annular space 114*a* is perforated, allowing production fluid to flow into the first portion of the annular space 114*a*.

In certain example embodiments, a first portion of the production tubing 106*a* adjacent the first portion of the annular space 114*a* and the first end 104 of the power generation system 102 is not perforated, such that production fluid flowing into the first portion of the wellbore 108*a* does not flow directly into the first portion of the production tubing 106*a*. Rather, in certain example embodiments, the production fluid flowing to the first portion of the wellbore 108*a* is forced to flow through the power generation system 102 and into the second portion of the annular space 114*b*. In certain example embodiments, a second portion of the production tubing 106*b* adjacent the second portion of the annular space 114*b* contains flow control valves 202, which allow the production fluid to flow from the second portion of the annular space 114*b* into the production tubing 106. The production fluid can then travel to the surface 112 where it is recovered.

In certain example embodiments, the inside of the production tubing 106 is only in communication with the annular space 114 via the power generation system 102, and thus production fluid is forced to travel through the power generation system 102 in order to enter the production tubing 106 and ultimately be recovered. In certain example embodiments, flow of production fluid through the power generation system 102 allows the power generation system 102 to generate power, which is stored in a power storage device 210, such as a rechargeable battery, capacitor, or the like.

In certain example embodiments, and as best shown in FIG. 2, the power generation system 102 includes at least one power generation path 204 and at least one bypass path 206. In certain example embodiments, production fluid must travel through either the power generation path 204 or the bypass path 206 in order to enter the production tubing 106. In certain example embodiments, the power generation path 204 includes one or more power generation mechanisms 208 disposed therein, which generate power when traversed by the flow of production fluid. In certain example embodiments, the power generation mechanism 208 can include piezoelectric power generation elements, turbomachinery, or other electromagnetic power generation devices. Thus, these components are activated and energy is generated when production fluid flows through the power generation path 204.

In certain example embodiments, the bypass path 206 is isolated from the power generation mechanism 208 and provides a path for production fluid to flow through the power generation system 102 without interacting with the power generation mechanism 208. Thus, the power generation mechanism 208 is bypassed and does not generate power when fluid flows only through the bypass path 206.

Both the power generation path 204 and the bypass path 206 provide a path for the production fluid to travel through. In certain example embodiments, the power generation path 204 and the bypass path 206 can be opened and closed in order to direct production fluid through the selected path. In certain example embodiments, the bypass path 206 is closed when the power generation path 204 is open. Thus, production fluid must travel through the power generation path 204, engage with the power generation mechanism 208, and power is generated. Alternatively, in certain example embodiments, the bypass path 206 is opened when the power generation path 204 is closed. As such, production fluid flows through the bypass path 206 and the flow is isolated from the power generation mechanism 208. Thus, the power generation mechanism is not active. This allows the power generation mechanism to rest when power generation is not needed, which increases the overall life of the power generation mechanism.

In certain example embodiments, the power generation system 102 can be controlled to switch between a power generation mode and a bypass mode. Accordingly, when the power generation system 102 is in the power generation mode, the power generation path 204 is open, production fluid flows therethrough, activating the power generation mechanism 208, and power is generated. In certain example embodiments, the generated power is saved in the power storage device 210. The power stored in the power storage device can then be used to power various electronic parts of the downhole assembly, such as actuators, valves, sensors, communication modules, and other devices. When the power generation system 102 is in the bypass mode, the power generation path 204 is closed, production fluid flows through the bypass path 206, and power is not generated. In certain example embodiments, both the bypass path 206 and the power generation path 204 are open during the power generation mode. In certain example embodiments, at least one power generation path 204 is inter-connected to at least one bypass path 206 such that the flow passing through the power generation mechanism 208 can exit through the bypass paths 206.

In certain example embodiments, the power generation system 102 includes a control system 212, which includes various control components such as a microprocessor, sensors, controllers, and the like. In certain example embodiments, the control system 212 controls the switching of the power generation system 102 between the power generation mode and the bypass mode. In certain example embodiments, the control system 212 controls the switching based on one or more parameters or predetermined operational conditions. For example, in a first group of embodiments, the control system 212 controls the switching based on actual power demand by measuring the amount of power currently stored in the power storage device 210. In certain such embodiments, the control system 212 senses the current power level of the power storage device 210 via one or more sensors and compares the current power level to a first threshold level. If the measured power level is below the first threshold level, then the control system 212 switches the power generation system 102 into the power generation mode. In certain example embodiments, when the power generation system 102 is in the power generation mode, the control system 212 may switch the power generation system 102 to the bypass mode after a certain period of time, or when the measured power level of the power storage device 210 is above a second threshold value. In certain example embodiments, the second threshold value is higher than the first threshold value. Effectively, the power generation system 102 is used to generate power when the stored power is running relatively low and not used when the store power is still relatively high, rather than continuously generating power regardless of actual demand. This reduces the amount of wear on the power generation mechanism 208, increasing the overall lifespan of the power generation system 102.

In a second group of example embodiments, not exclusive of embodiments in the first group, the control system 212 controls switching between the power generation mode and the bypass mode based on current operational conditions, operational demands, and/or a preprogrammed protocol. For example, in one embodiment, the control system 212 switches the power generation system 102 to the power generation mode in anticipation of a power-consuming event such as actuating a valve. In certain example embodiments, the power generation system 102 is put in the power generation mode during or after such an event. In certain example embodiments, the power generation system 102 is put in the bypass mode after such an event occurs. In certain example embodiments, the control system 212 switches the power generation system 102 to the power generation mode at certain time intervals. In certain example embodiments, the control system 212 is preprogrammed to control the power generation system 102 in accordance to a protocol or program. The protocol or program defines the conditions under which the power generation system 102 is to be put in the power generation mode and the conditions under which the power generation system 102 is to be put in the bypass mode. Such conditions may include stored power level, time interval, actuation, certain events, and so forth. This allows the power generation system 102 to autonomously switch between the power generation mode and bypass mode without intervention, and further allows the power generation system 102 to provide maximum utility and reduce waste.

In certain example embodiments, switching between the power generation mode and the bypass mode includes mechanical actuation, such as driving a motor, which mechanically opens and closes the power generation path 204 and the bypass path 206. In certain example embodiments, the switching includes expansion, contraction, or axial movement of a plug or packer type device in the power generation path 204 and the bypass path 206, in which the device blocks the respective path when expanded. In certain example embodiments, the power generation system 102 may operate in the bypass mode as a default when the control system 212, the power generation mechanism 208, or other necessary component fails or is out of commission.

Figure 3:
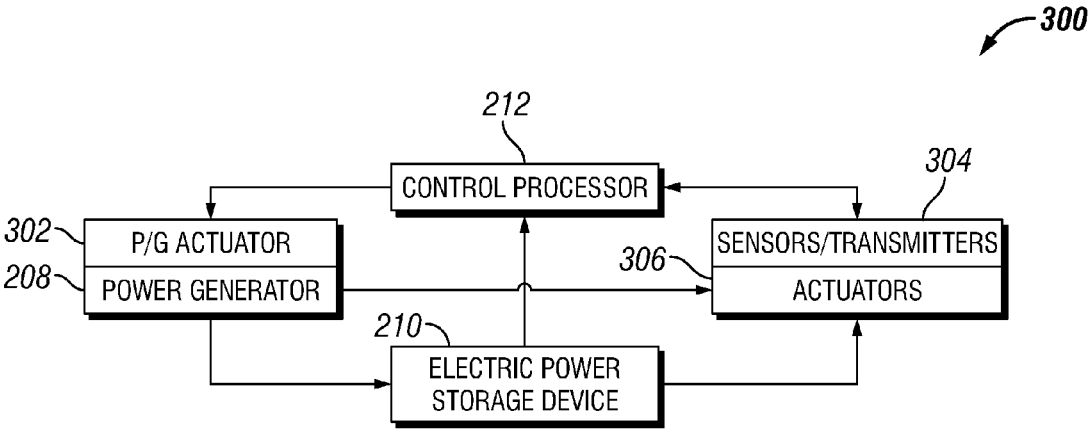
FIG. 3 illustrates a block diagram of the power generation system, in accordance with example embodiments of the present disclosure.

FIG. 3 illustrates a block diagram 300 of the power generation system 102, in accordance with example embodiments of the present disclosure. In certain example embodiments, the block diagram 300 includes the control system 212, the power storage device 210, the power generator mechanism 208 which is coupled to a power generator actuator 302, and one or more actuators 306 and sensors or transmitters 304 that the downhole assembly may have. In certain example embodiments, the control system 212 sends control commands to the power generator actuator 302, which then actuates the power generator mechanism 208 accordingly. The power generator mechanism 208 generates power and sends the power to be stored in the power storage device 210. The power storage device 210 provides power to the control system 212, the actuators 306, and sensors and transmitters 304. In certain example embodiments, the control system 212 also controls and communicates with the sensors/transmitters 304 which are coupled to and communicate with the actuators 306. In certain example embodiments, the power storage device 210 provides a signal to the control system 212 indicative of the amount of power stored in power storage device 210.

Figure 4:
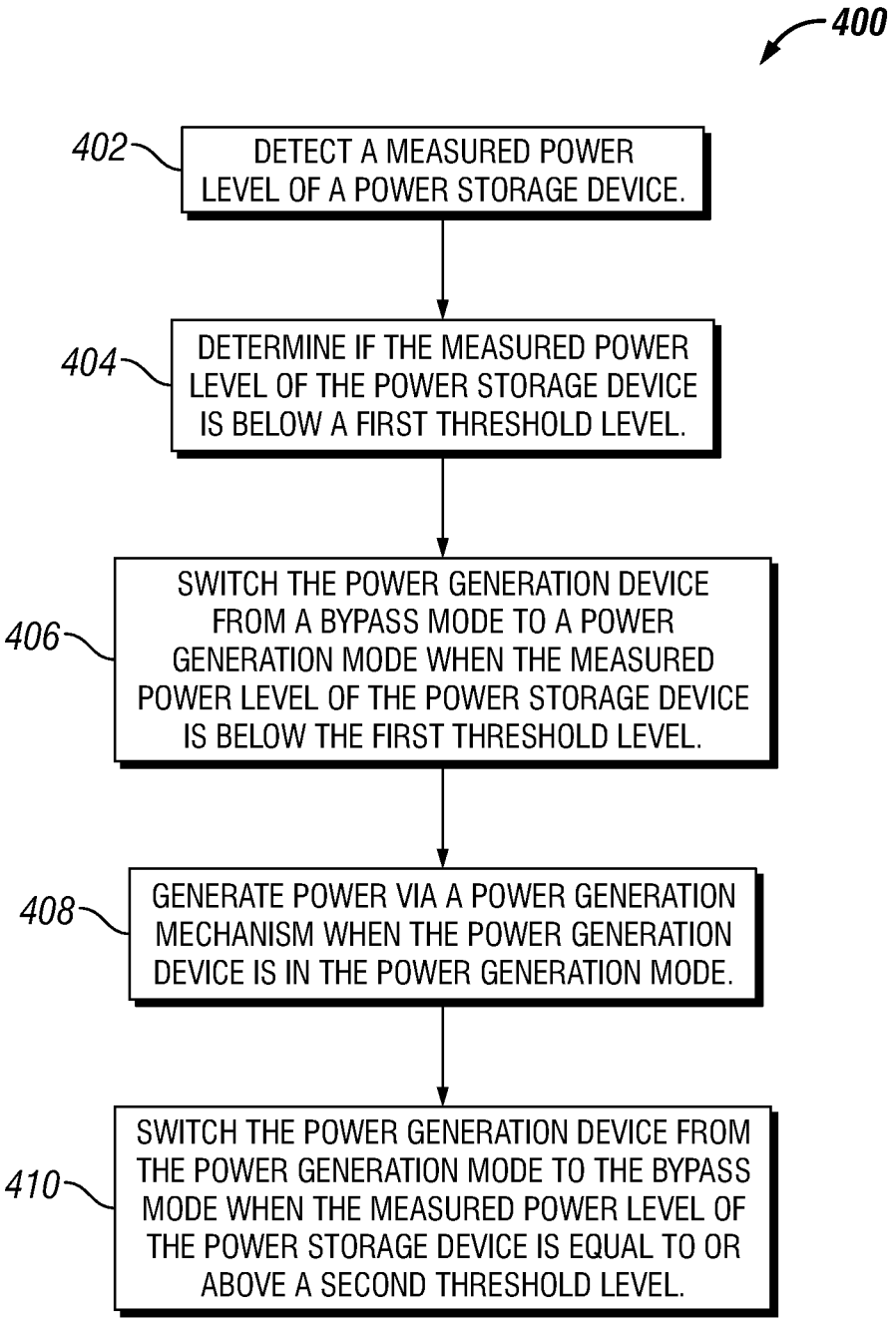
FIG. 4 illustrates a method of autonomous control of the power generation system based on the current power level of the power storage device, in accordance with example embodiments of the present disclosure.

FIG. 4 illustrates a method 400 of autonomous control of the power generation system 102 based on the current power level of the power storage device 210, in accordance with example embodiments of the present disclosure. In certain example embodiments, controlling of the power generation system 102 is performed by the control system 212 of the power generation system 102 and includes switching between operating the power generation system 102 in the power generation mode and operating the power generation system 102 in the bypass mode. Referring to FIG. 4, the method includes detecting the current power level of a power storage device 210 (step 402). In certain example embodiments, the control system 212 is coupled to a sensor or electrical connection which senses the amount of power stored in the power storage device 210 and receives the value as data. The method 400 further includes determining if the measured power level of the power storage device is below a first threshold level (step 404), and switching the power generation device from a bypass mode to a power generation mode when the measured power level of the power storage device 210 is below the first threshold level (step 406). In certain example embodiments, the control system 212 compares the measured power level to the first threshold value stored in memory and puts the power generation system 102 into the power generation mode if the measured power level is lower than the first threshold value. Thus, the power generation path 204 is opened and production fluid is directed to flow therethrough, engaging the power generation mechanism 208 and generating power (step 408). In certain example embodiment, the method 400 includes switching the power generation system 102 from the power generation mode to the bypass mode when the measured power level of the power storage device 210 is equal to or greater than a second threshold value (step 410). In certain example embodiments, the second threshold value may represent the full charge capacity of the power storage device.

Figure 5:
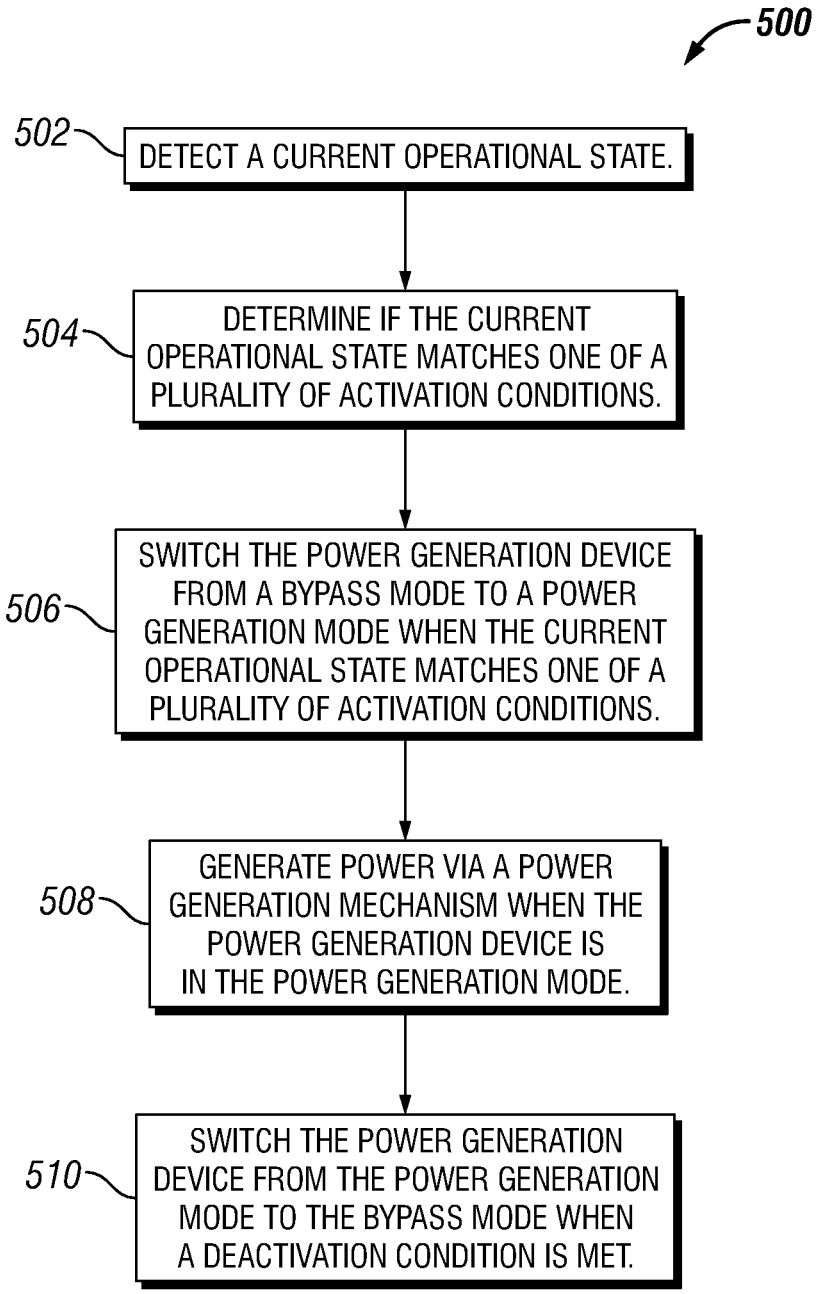
FIG. 5 illustrates a method of autonomous control of the power generation system based on a preprogrammed operational protocol, in accordance with example embodiments of the present disclosure.

FIG. 5 illustrates a method 500 of autonomous control of the power generation system 102 based on a preprogrammed operational protocol, in accordance with example embodiments of the present disclosure. In certain example embodiments, controlling of the power generation system 102 is performed by the control system 212 of the power generation system 102 and includes switching between operating the power generation system 102 in the power generation mode and operating the power generation system 102 in the bypass mode. Referring to FIG. 5, the method includes detecting a current operational condition or parameter of the downhole assembly to which the power generation system 102 is coupled (step 502). The method 500 further includes determining if the current operational condition or parameter matches one of a plurality of activation conditions (step 504), and switching the power generation device from a bypass mode to a power generation mode when the current operational condition or parameter matches one of a plurality of activation conditions (step 506) saved in memory as a part of a preprogrammed operational protocol. For example, the plurality of activation conditions may include actuation of a valve, a certain time parameter, and any other event in which it is desirable or advantageous to trigger the power generation mode and generate power. When the power generation system 102 is put into the power generation mode, the power generation path 204 is opened and production fluid is directed to flow therethrough, engaging the power generation mechanism 208 and generating power (step 508). In certain example embodiment, the method 500 includes switching the power generation system 102 from the power generation mode to the bypass mode when a deactivation condition is met (step 510). In certain example embodiments, the deactivation parameter is when the current operational state no longer matches one of the plurality of activation conditions. In other example embodiments, the deactivation parameter is a certain time period after switching to the power generation mode. In certain example embodiments, events or conditions which trigger the control system 212 to automatically put the power generation system 102 into the power generation mode or the bypass mode can be any type of condition that can be programmed into the memory or processor of the control system 212, and are not limited to the examples discussed above.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. An autonomous downhole power generation system, comprising:

a power generation device configured to be disposed in an annular space around a portion of a production tubing, wherein the power generation device is switchable between a power generation mode and a bypass mode;

a power storage device electrically coupled to the power generation device and configured to store power generated by the power generation device; and a control processor communicatively coupled to the power storage device and the power generation device, wherein the control processor receives a measure of power stored in the power storage device and switches the power generation device between the power generation mode and the bypass mode based on the measure of power, wherein the power generation device comprises a power generation path and a bypass path, wherein the power generation path comprises a power generation mechanism which generates power when traversed by fluid, wherein the power generation path is open in the power generation mode, and wherein, in the bypass mode, the power generation path is closed and the power generation mechanism is isolated from the bypass path.

2. The autonomous downhole power generation system of claim 1, wherein the power generation mechanism comprises at least one of a piezoelectric power generation element, a turbine power generation component, or an electromagnetic induction power generation device.

3. The autonomous downhole power generation system of claim 1, wherein the control processor switches the power generation device to the power generation mode when the measure of power stored in the power storage device is below a first threshold level.

4. The autonomous downhole power generation system of claim 3, wherein the control processor switches the power generation device to the bypass mode when the measure of power stored in the power storage device is above a second threshold level.

5. The autonomous downhole power generation system of claim 3, wherein the control processor switches the power generation device to the bypass mode when the power storage device is fully charged.

6. The autonomous downhole power generation system of claim 1, wherein the power generation path is inter-connected to the bypass path.

7. The autonomous downhole power generation system of claim 1, wherein the control processor is communicatively coupled to a sensor that senses an amount of power stored in the power storage device.

8. The autonomous downhole power generation system of claim 1, wherein the control processor is configured to compare the measure of power stored in the power storage device to a first threshold value stored in memory.

9. The autonomous downhole power generation system of claim 1, wherein the control processor is communicatively coupled to a power generator actuator that is configured to actuate the power generator mechanism.

* * * * *